US012042692B2

(12) United States Patent
Adamczyk et al.

(10) Patent No.: US 12,042,692 B2
(45) Date of Patent: Jul. 23, 2024

(54) HAPTIC REHABILITATION

(71) Applicant: Wisconsin Alumni Research Foundation, Madison, WI (US)

(72) Inventors: Peter Gabriel Adamczyk, Madison, WI (US); Alexander Raymond Dawson-Elli, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 191 days.

(21) Appl. No.: 17/393,197

(22) Filed: Aug. 3, 2021

(65) Prior Publication Data

US 2022/0032119 A1 Feb. 3, 2022

Related U.S. Application Data

(60) Provisional application No. 63/060,355, filed on Aug. 3, 2020.

(51) Int. Cl.
*A63B 22/06* (2006.01)
*A63B 24/00* (2006.01)

(52) U.S. Cl.
CPC ..... *A63B 22/0605* (2013.01); *A63B 24/0062* (2013.01); *A63B 24/0075* (2013.01); *A63B 24/0087* (2013.01); *A63B 2022/0611* (2013.01); *A63B 2022/0652* (2013.01); *A63B 2220/30* (2013.01); *A63B 2220/51* (2013.01)

(58) Field of Classification Search
CPC ..... A63B 22/0605; A63B 24/0062; A63B 24/0075; A63B 24/0087; A63B 2022/0611; A63B 2022/0652; A63B 2220/30; A63B 2220/51
See application file for complete search history.

(56) References Cited

U.S. PATENT DOCUMENTS

| | | | | |
|---|---|---|---|---|
| 11,458,354 | B2 * | 10/2022 | Bissonnette | A63B 23/03516 |
| 2016/0136483 | A1 * | 5/2016 | Reich | A63B 21/153 482/5 |
| 2019/0358483 | A1 * | 11/2019 | Fuchs | A63B 24/0087 |
| 2022/0104989 | A1 * | 4/2022 | Dixon | A61N 1/36031 |

FOREIGN PATENT DOCUMENTS

WO WO-2020185769 A1 * 9/2020 ..... A61H 1/0214

* cited by examiner

*Primary Examiner* — Sundhara M Ganesan
*Assistant Examiner* — Jacqueline N L Loberiza
(74) *Attorney, Agent, or Firm* — Crawford Maunu PLLC

(57) ABSTRACT

Aspects of the present disclosure are directed toward apparatuses and methods for rendering haptic environments, such as may be used in rehabilitation. As may be implemented in accordance with one or more embodiments, haptic rehabilitative movement is effected by providing feedback signals characterizing sensed engagement of a user's lower extremity with a crank coupled to a shaft that is driven by a motor, and controlling movement of the crank in response to the feedback signals. Force may be provided by the motor and shaft, by applying control inputs to the motor that cause the motor and crank to render respective haptic environments while engaged with the user's lower extremity, via rotation of the shaft. The haptic environments may include one or both of impedance-based haptic environments and admittance-based haptic environments.

20 Claims, 8 Drawing Sheets

HAPTIC REHABILITATION

STATEMENT REGARDING FEDERALLY SPONSORED RESEARCH AND DEVELOPMENT

This invention was made with government support under HD065690 and TR002373 awarded by the National Institutes of Health and under 1830516 awarded by the National Science Foundation. The government has certain rights in the invention.

OVERVIEW

Aspects of the present disclosure are directed to motor learning and/or rehabilitative apparatuses and related methods.

As an overview, various robotics have been utilized in establishing motor learning principles for limb therapy for patients with a variety of different types of conditions. The mechanical environment of a limb (e.g., arm and hand) allows experimenters to present subjects with tasks they have not encountered previously, and to then observe the processes of motor adaptation and learning.

While useful, certain approaches to training various limbs can fall short in early enrollment and volitional engagement. Task-specific training may also unintentionally reward functional compensations instead of true neuroplastic recovery. Furthermore, robotic equipment can be expensive, challenging to design, control and implement. These and other issues have presented challenges to various approaches for motor learning, such as those utilized for rehabilitation.

SUMMARY

Various embodiments are directed toward apparatuses and related methods that address the aforementioned issues. A particular embodiment is directed to an apparatus having a shaft with a crank coupled thereto, and a user support structure to support a user while a lower extremity of the user is engaged with the crank. The crank is configured to translate mechanical force (e.g., as may include a torque force) between the shaft and the user's lower extremity, with the shaft being configured to rotate. The apparatus also includes feedback circuitry, and motor control circuitry that operates therewith. The feedback circuitry senses engagement of the user with the crank and provides feedback signals characterizing the sensed engagement. The motor control circuitry provides haptic rehabilitative movement by using the feedback signals to control movement of the crank via the motor and shaft. This control includes applying control inputs to the motor that cause crank to render respective impedance-based and/or admittance-based haptic environments, while engaged with the user's lower extremity via rotation of the shaft.

Various embodiments are directed to methods as may be implemented in accordance with the above and/or one or more other approaches characterized herein. In a particular embodiment, a method for providing haptic rehabilitative movement and/or force/torque is carried out as follows. Feedback signals are obtained for characterizing sensed engagement of a user's lower extremity with a crank, which is coupled to a shaft that is driven by a motor. Movement of the crank is controlled via the motor and shaft using the feedback signals, by applying control inputs to the motor that cause crank to render respective impedance-based and/or admittance-based haptic environments while engaged with the user's lower extremity, via rotation of the shaft.

The above discussion/overview is not intended to describe each embodiment or every implementation of the present disclosure. The figures and detailed description that follow also exemplify various embodiments.

BRIEF DESCRIPTION OF FIGURES

Various example embodiments may be more completely understood in consideration of the following detailed description and in connection with the accompanying drawings, in which:

FIGS. 1A-1C show respective views of a recumbent haptic apparatus in accordance with one or more embodiments, in which FIG. 1A shows a perspective view, FIG. 1B shows a left side view, and FIG. 1C shows an enlarged view of a drivetrain shown in FIGS. 1A and 1B;

Figure 1A:
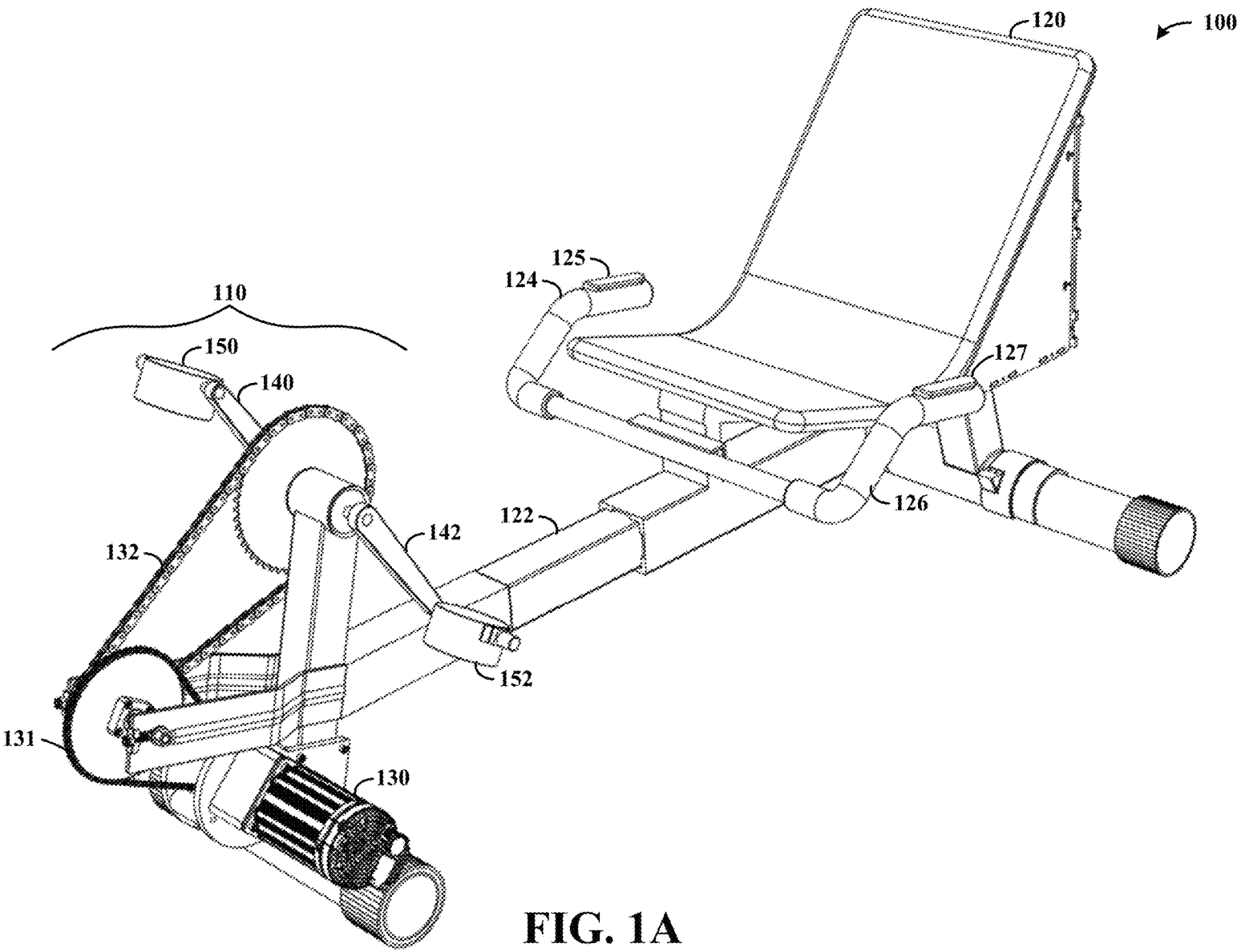

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as may be used throughout this application is by way of illustration, and not limitation.

DETAILED DESCRIPTION

Aspects of the present disclosure are believed to be applicable to a variety of different types of articles of manufacture, apparatuses, systems and methods involving rehabilitation. In certain implementations, aspects of the present disclosure have been shown to be beneficial when used in the context of mechanically interacting with a user to facilitate rehabilitative conditions as may involve one or more of movement, force and torque (which may be referred to as a twisting force). Further aspects are directed to interacting in such contexts by dynamically changing rehabilitative conditions based on feedback that characterizes the user and/or the user's response, and which may further be based a type of rehabilitative therapy to be provided. While not necessarily so limited, various aspects may be appreciated through a discussion of examples using such exemplary contexts.

In accordance with various example embodiments, it has been recognized/discovered that multi-axis movement and force/torque can be achieved for rehabilitation with fewer (or only one) axis of movement. In some instances, out-of-plane movement, force and/or torque is utilized for training using a single plane of movement and/or an apparatus providing force/torque with a single degree of freedom. For instance, reaching-type movements may be effected in different haptic environments to develop motor competency through tasks/subtasks, such as those relating to gait.

Various such embodiments are directed to an apparatus and method involving rotary motion, such as may be delivered by a bicycle-type crank and shaft that provides circular motion in a particular plane. In such embodiments, movement, forces and torque can be utilized within the plane of circular motions, while further sensing and using forces and torque out of the plane such as by sensing force applied to a pedal attached to a crank. Such approaches may be utilized in a variety of rehabilitative environments, such as for training lateral foot control as may relate to stroke patients, which may utilize approaches involving rewarding and/or penalizing certain movement or application of force/torque. For instance, such approaches may facilitate goal-directed movement tasks in the lower limb, such as by utilizing reaching tasks, with mechanical interactions that may elicit desired motor adaptation. Functions may be implemented for sub-tasks, such as for pedaling while maintaining inward pressure or outward pressure, or a mix of both for different regions of rotation. These and other aspects herein may be utilized to address challenges, including those characterized hereinabove.

A variety of types of feedback may be obtained in a variety of manners, and utilized in providing a haptic environment. For instance, where a bicycle type apparatus is used, forces or torques measured at pedals, the angle at a crank, angles of pedals on spindles, and muscle activity are examples of types of feedback that can be obtained. Such feedback may be obtained using one or more sensors on the user, within pedals, within the user's shoes or prosthetic, in the crank, or other location at which a desired characteristic may be sensed. Human movement measurement and/or modeling may be obtained and used as feedback as well, for instance using inertial measurement units as may include accelerometers and/or angular rate gyroscopes, or motion capture (e.g., optical or magnetic).

As recited herein, haptic rehabilitative functions may involve creating constraints between variables (e.g., known variables, feedback), and using the constraints to create a smaller set of outputs that may relate to generating or resisting movement, force and/or torque. Using such approaches, a human an apparatus as characterized herein may learn about the haptic environment and train their body, such as for learning to walk after a stroke. Various approaches involve training the human nervous system and may include training perception, decision-making, and execution. Certain implementations involve creating environments that a user/patient has not interacted with previously, such as out-of-plane or partial out-of-plane interactions. Such haptic environments may simulate or emulate one or more of springs, viscous dampers, masses or inertias, spring-mass-damper systems, systems with multiple springs, masses and dampers, systems that simulate negative mass/inertia, friction forces, spatially-distributed patterns of opposing force (e.g., "torque lump"), viscous curl fields, cross-axis springs, dampers with viscosity controlled by specific directions of force or combinations or patterns of muscle activity, control laws with speed activated by the similarity of the observed muscle activation pattern to a desired pattern, and control laws that respond differently (e.g., oppositely) to a user's legs.

Certain embodiments are directed to a powered, instrumented robotic exercise cycle-type apparatus that may provide rotation in a single plan, for instance in a manner similar to a stationary cycle. Such an apparatus may be used to present cognitively demanding reaching and pedaling tasks in haptic mechanical environments, for instance with a user's lower limb.

In a particular embodiment, a recumbent exercise cycle apparatus is powered with a servomotor and instrumented with pedal and crank. The apparatus may employ one or more of angular encoders, force-torque sensing pedals, and wireless electromyography (EMG) componentry. The recumbent posture may be used to separate targeted tasks of motor coordination from (sometimes confounding) demands of upright balance and weight support. The recumbent posture may also be utilized to facilitate robotic rehabilitation earlier in the process of recovery, for instance relative to other approaches that may rely upon weighted support (e.g., treadmill training or exoskeleton walking). Virtual environments ranging from spring-mass-damper systems to mechanical laws involving an inertial curl or half-reversed pedaling may be utilized present variants of leg-reaching and pedaling tasks that challenge perception, cognition, motion planning, and motor control systems.

Various embodiments are directed toward an apparatus having a shaft with a crank coupled thereto, and a user support structure to support a user while a lower extremity of the user is engaged with the crank. The crank is configured to translate mechanical force between the shaft and the user's lower extremity, with the shaft being configured to rotate. The apparatus also includes feedback circuitry, and motor control circuitry that operates therewith. Specifically, the feedback circuitry senses engagement of the user with the crank and provides feedback signals characterizing the sensed engagement. The motor control circuitry provides haptic rehabilitative movement by using the feedback signals to control movement of the crank via the motor and shaft. This control includes applying control inputs to the motor that cause crank to render respective impedance-based and/or admittance-based haptic environments, while engaged with the user's lower extremity via rotation of the shaft. Further, two such cranks may be provided, both coupled to the shaft and respectively rotating in different planes (e.g., pedals attached to each crank rotating in respective planes), and which may be implemented in a manner similar to a bicycle.

Haptic rehabilitative movement may be provided in a variety of manners. For instance, cyclic pedaling, similar to a recumbent bicycle, may be provided with a pedal or other component attached to the crank. Such pedaling may be coupled with out-of-plane movement, such as by instructing the user to apply force in a direction outside of a plane in which the rotation is provided, as may include inward or outward force relative to the shaft. Applied out-of-plane forces applied may be sensed and used to provide feedback, which may be used to control the pedaling such as by providing more or less resistance, or other feedback to the user. Resistance can be varied along a cyclic path, independent from and/or in connection with any feedback obtained concerning the pedaling and forces applied therewith. One such approach involves providing a torque lump, in which a specific part of the cycle has a higher resistance torque than the rest, or in which the torque otherwise varies at different portions of the cycle. Non-cyclic pedaling may also be provided, for instance by moving the crank for a partial cycle in one direction, and then reversing the direction. Half-reversed pedaling may be provided, in which a negative mass law is utilized for one of the user's legs (e.g., with the other leg also engaged with the shaft via a second crank). Accordingly, haptic rehabilitation may involve one or more of position, velocity and/or torque, and may not necessarily require movement.

The motor control circuitry may be implemented in a variety of manners. In some embodiments, the motor control circuitry applies control inputs to the motor that cause the crank to exhibit a force, movement or torque that dynamically changes based on one or both of the sensed engagement of the user and a type of rehabilitative motion to be provided. The motor control circuitry may utilize the feedback signals to characterize deficits and capacity in performance of the user's lower extremity, and modify control of the movement of the crank in response to the characterized deficits and capacity.

In a particular embodiment, the motor control circuitry controls movement of the crank by utilizing the feedback circuitry to measure a signal from the user's body indicative of the user's response to the haptic rehabilitative movement, and providing an output value for an available output, using a mathematical model that relates the measured signal to the available output. The crank is then actuated using one or both of impedance-based control and admittance-based control, based on the output value. For instance, one or more of the user's muscle activity, emotional activity, and motion may be utilized to provide an output value for an available output, such as a torque control output, speed output or directional output. Such an output may correspond to mechanical characteristics of the crank such as position, velocity, force, and a combination thereof. In some implementations, the output value is selected in response to the user's ability to control the lower extremity, as detected via the feedback circuitry. This may be utilized to reward or penalize the user's activity, such as by rewarding cyclic control of lateral force (e.g., instructing a user to apply lateral inward or outward force while pedaling cyclically). Such reward/penalty may be a visual, audio or other output, or may relate to the pedaling (e.g., making pedaling easier).

Motor control circuitry as characterized above may actuate the crank using impedance-based control, admittance-based control, or a combination thereof. For instance, velocity and/or position of the crank caused by the user may be detected, and force may be applied to the crank based on the detected velocity and/or position to effect impedance-based control. The crank may be actuated using admittance-based control by imposing motion of the user based on detected force, position or velocity.

Memory circuitry may accessed and used to effect control in a variety of manners. For instance, mathematical models corresponding to different types of haptic rehabilitation may be stored in memory and selected for providing an output value for controlling movement of the crank. The motor control circuitry may select one of the mathematical models based on received user input and/or feedback obtained. For instance, a mathematical model may be selected based on forces sensed from a user pedaling. A user such as a patient or therapist may directly select one of the mathematical models, or may provide an input depicting a type of rehabilitation to be utilized with the input being analyzed to determine which mathematical model (or models) to be used. The mathematical models may have one or more variables corresponding to the sensed engagement of the user, with the sensed engagement being used as such a variable.

The feedback circuitry may sense engagement of the user in a variety of manners. In some implementations, the feedback circuitry senses one or more of foot position, leg position, foot angle, force applied between the foot and crank, muscular activity, and emotions. A variety of sensors may thus be used. For instance, sensors may be used to ascertain the angle of an ankle, pointing of toes, muscle activity at one or more points in a cycle, torque applied to a pedal, trunk posture, arm posture, force applied by the user's hands (e.g., characterizing the need for a stabilizing grip), and others. As such, electrical, mechanical, optical, sound, and other sensors may be used to obtain such feedback.

In certain implementations, the apparatus includes a user interface that provides information to the user, with the motor control circuitry being configured with the user interface to provide user feedback and task specification based on the sensed engagement. For instance, a graphical user interface (GUI) may provide information about the nature of a task to be performed, or may provide misleading information about the nature of the task to create a conflict/interference paradigm. Such a GUI may provide explicit guidance on how to perform a task, may set target goals for movement, may display performance metrics and rewards or other features (e.g., clock, speedometer, thermometer, target bar, strip chart), and may provide real-time biofeedback of force at the pedals and motion of the pedals and crank (and, e.g., targets for these quantities). Two dimensional or three dimensional (e.g., virtual reality headsets) may be utilized in this regard.

The crank, shaft and motor may be implemented in a variety of manners, and may be replaced by different components that provide for rotational movement. In some implementations, the crank operates with the shaft to limit movement to one degree of freedom rotational movement in a single plane, such as may involve fixed rotation of a pedal along a circumferential path. The motor control circuitry may provide the haptic rehabilitative movement for training out-of-plane movement by dynamically controlling the translated mechanical force while rotating the crank in the single plane.

In certain implementations, the motor control circuitry causes the crank to render the respective impedance-based and/or admittance-based haptic environments by moving to and maintaining respective positions and/or associated forces corresponding to reach-locations for the user. In such implementations, the feedback circuitry provides feedback signals characterizing engagement of the user with the crank at each reach-location. In accordance with a particular implementation, the motor control circuitry causes the crank to render the impedance-based haptic environments using position and/or velocity as an input and controlling force and/or torque in response thereto.

In certain implementations in which the crank operates with the shaft rotate in a plane to provide single degree of freedom movement, the feedback circuitry includes sensor circuitry that senses force and torque in the plane and that also senses out-of-plane force and torque applied by the user to the crank. Different combinations of sensor components may be used to achieve such measurements. The sensor components may be embedded in a pedal, in the crank, shaft or motor, on the user, or on any location via which a desired measurement may be obtained.

Figure 1B:
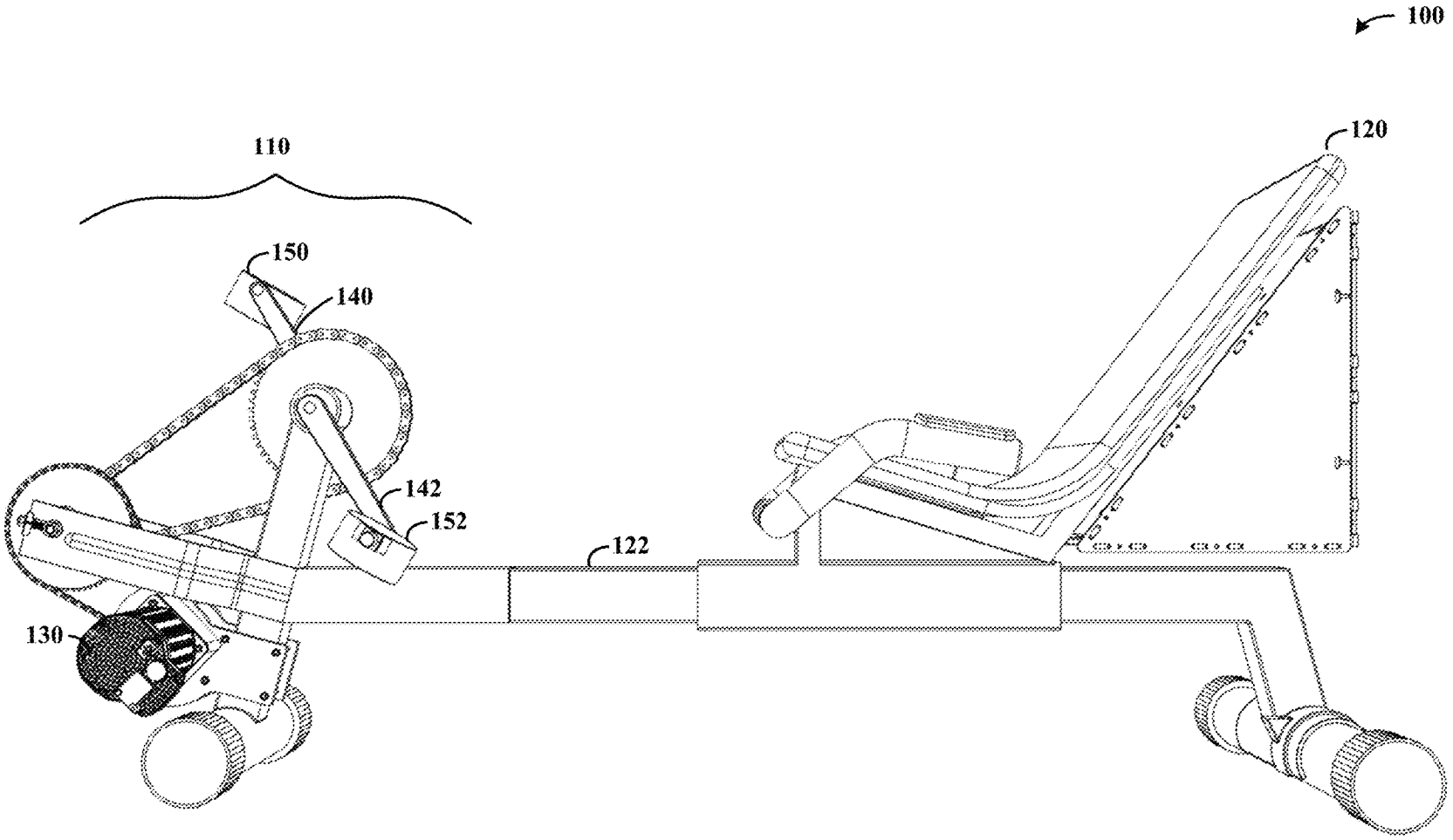
Figure 1C:
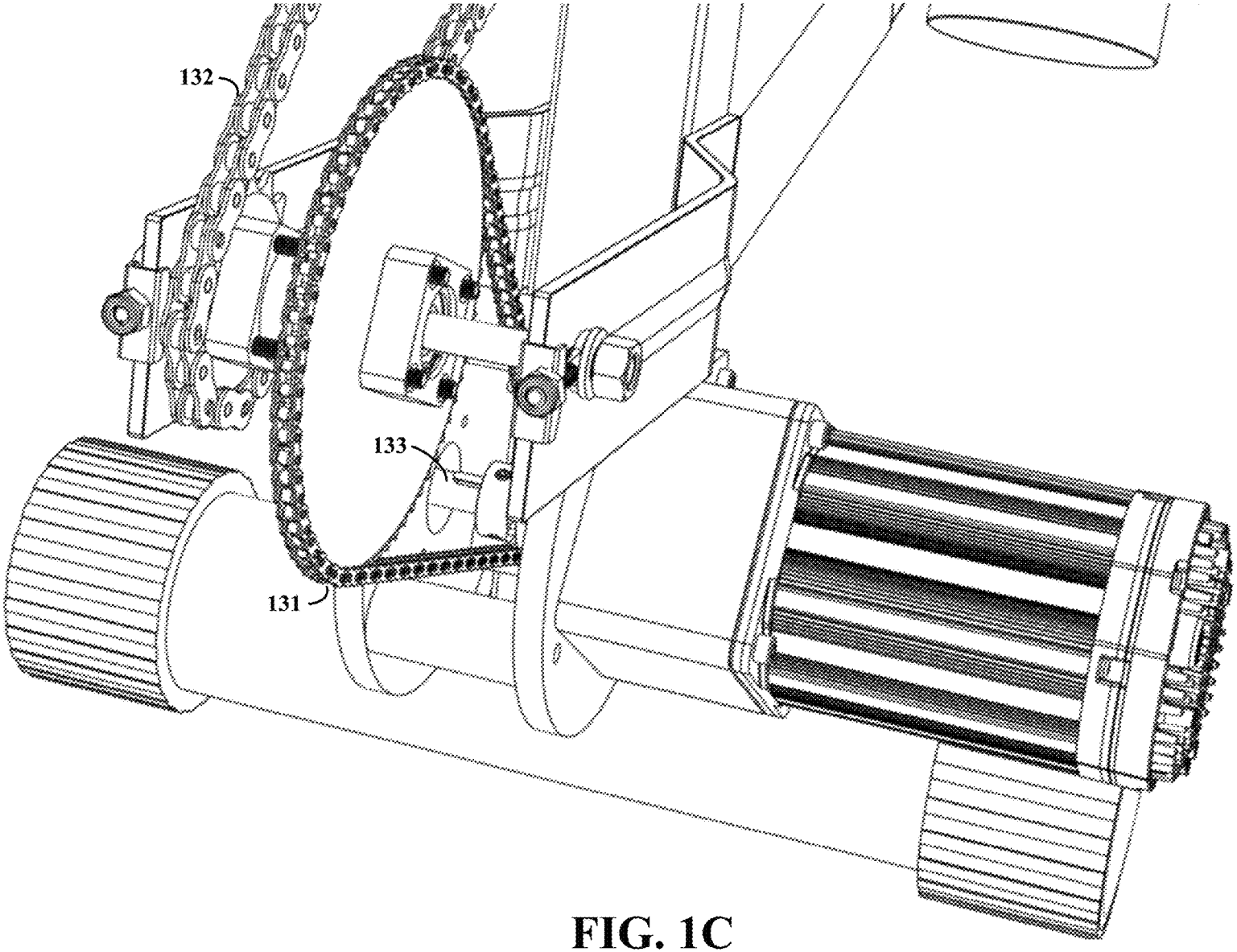

Turning now to the figures, FIGS. 1A-1C respectively show perspective, left side and drivetrain views of a recumbent haptic apparatus 100, in accordance with one or more embodiments. The apparatus 100 is shown with a drivetrain 110 and a seat 120 (e.g., adjustable) respectively for engaging with a user's legs and supporting the user's weight. A supporting structure 122 (e.g., adjustable channel) connects the seat 120 and drivetrain 110. The drivetrain 110 includes a motor 130 that drives a shaft and, via the shaft, drives cranks 140 and 142 to which pedals 150 and 152 are respectively coupled. By way of example, the motor 130 is shown driving chains 131 and 132, which respectively translate energy from an output shaft 133 of the motor (as shown in FIG. 1C) to the cranks 140 and 142. However, various embodiments involve other connectivity, such as with the motor 130 connected to directly drive the respective cranks 140 and 142 (e.g., via a connecting shaft), or to directly drive the chain 132. Further, other drive components such as gears and belts may be used to translate motion/torque between the motor 130 and the cranks 140/142, and ultimately to a user via pedals 150/152.

The apparatus 100 includes one or more of a variety of sensors to provide feedback. For instance, the pedals 150 and 152 may include one or more sensors integrated therewith. Such pedal-based sensors may sense force applied to the pedal, position of the pedal, force in an out-of-plane direction relative to a plane in which the pedal sensor rotates (e.g., inward toward and/or outward from the crank), and torque (e.g., applied in any of the same directions). The cranks 140/142 or the shaft/componentry connecting them may include one or more sensors for sensing similar forces or torque, or position. The chair 120 may include handles 124 and 126, which may respectively include sensors 125 and 127 for sensing one or more of hand position, hand grip, and hand torque/lifting as may be applied by a user. The motor 130 and/or shaft 133 may include sensors for assessing resistance applied to the pedals, and aspects as may relate to rotation, torque or force. Remote sensors, as may be wired or wireless, may further be connected to a user of the apparatus 100 and be utilized to drive the motor 130. Accordingly, the motor 130 may include circuitry integrated therein that processes sensor feedback and controls position, force, torque and/or other aspects pertaining to rotation of the cranks 140/142. In addition, one or more aspects of the embodiments characterized in the attached Appendix, which forms part of this patent document, may be utilized with the apparatus 100.

Figure 2:
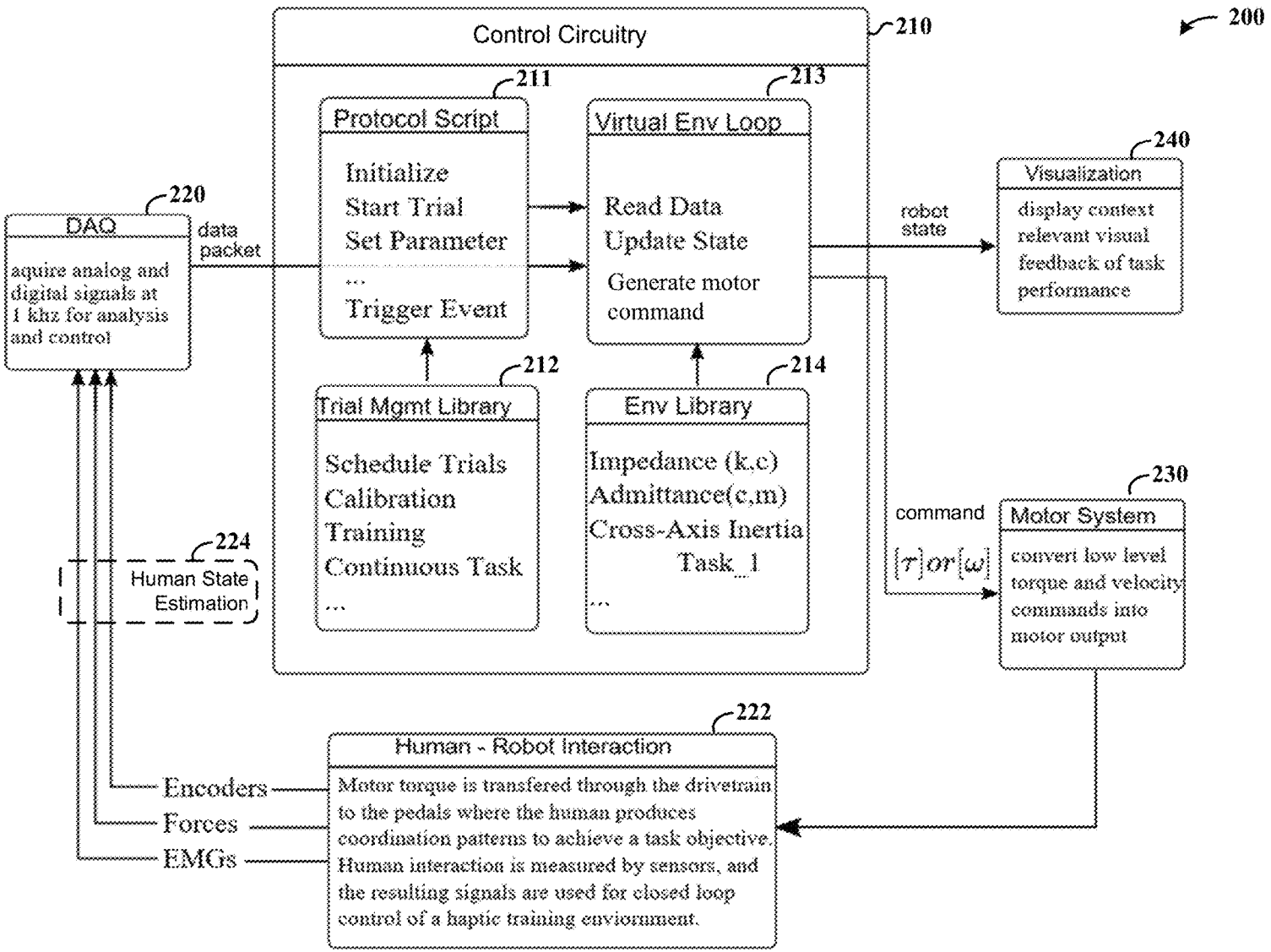
FIG. 2 shows a control apparatus with circuit modules/blocks, as may be implemented in accordance with various embodiments.

FIG. 2 shows a control apparatus 200 with circuit modules/blocks, as may be implemented in accordance with various embodiments. Control circuitry 210 operates using sensor inputs, as provided by sensor acquisition circuitry 220, to control a motor system 230 which may convert low level torque and velocity commands into a motor output. In some implementations, a GUI or other type of circuit is used to display context relevant feedback of task performance at 240.

Analog and/or digital signals may be acquired at sensor acquisition circuitry 220 as may be received from force sensors, EMG sensors, encoders, human movement sensors as may incorporate modeling and/or sensor measurement, inertial measurement units or motion capture sensors, or others. Such sensor information may be obtained via human-robot interaction as depicted at block 222, which may involve sensing human interaction to motor torque translated through a drivetrain such as that depicted in FIGS. 1A-1C. The signal may be utilized to create a haptic environment for training. In some implementations, a human state estimation block 224 is utilized to estimate one or more aspects of a user of the apparatus, and to provide outputs that the control circuitry 210 may also use in creating a haptic environment.

The control circuitry 210 may include a variety of circuits/modules. A protocol script module 211 may be implemented to start a trial as may pertain to providing a certain haptic environment. Alternately and/or in addition, a GUI may be utilized to interact with a patient or coach/therapist using the apparatus to determine a haptic environment to be created. Such environments may be created, for instance by storing executable data that generates an output as executed, for calibration, training or providing a continuous task via module 212. A virtual envelope loop module 213 generates command outputs for controlling the motor system module 230 to carry out haptic functions, and may further provide an output for displaying a visual output at 240. An envelope library 214 may be utilized to provide certain environments as may relate to impedance, admittance, cross-axis inertia or other particular task, for interacting with a user.

Figure 3:
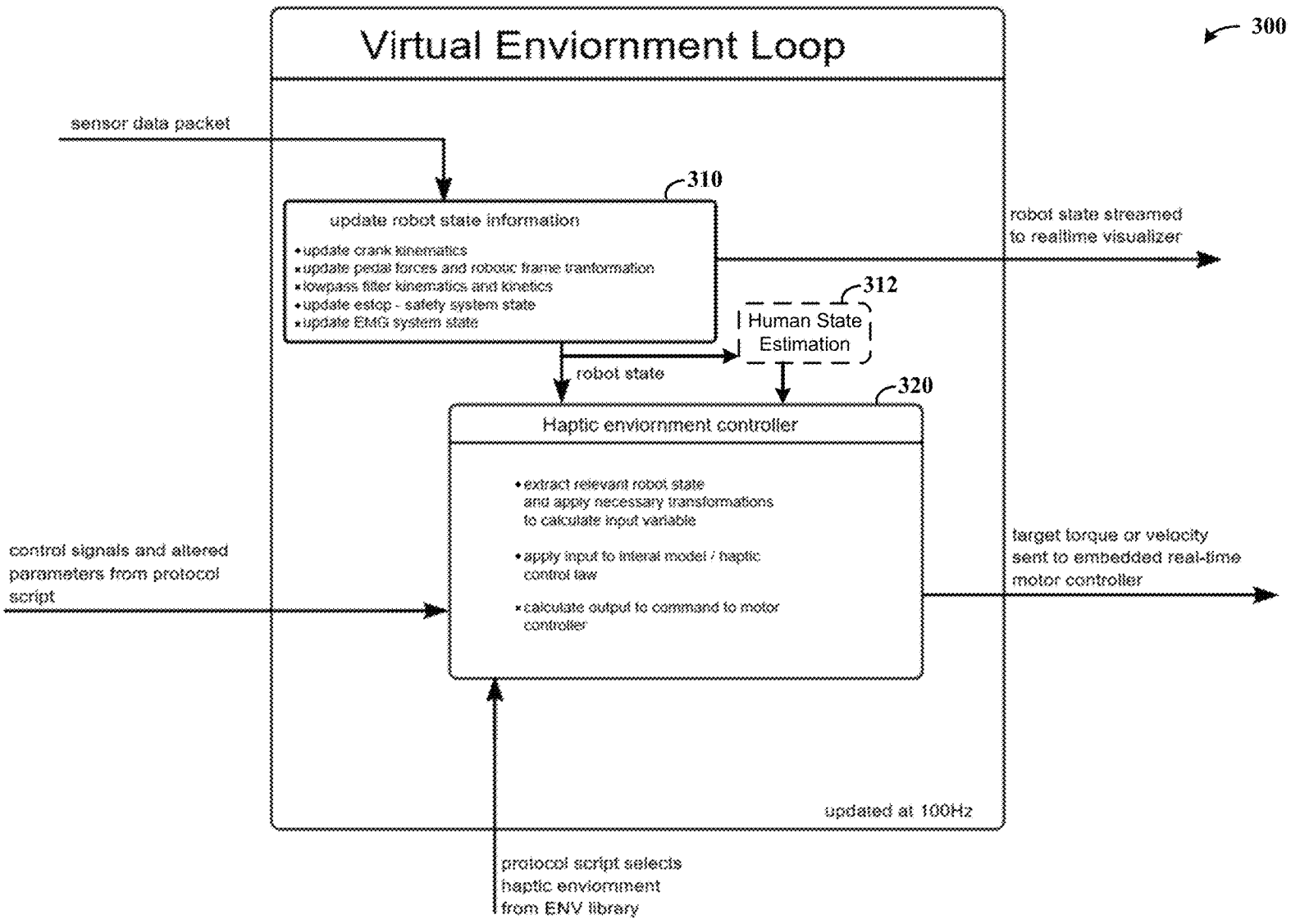
FIG. 3 shows a flow diagram for operating a haptic apparatus in a virtual environment loop, as may be implemented in accordance with various embodiments.

FIG. 3 shows a flow diagram 300 for operating a haptic apparatus in a virtual environment loop, as may be implemented in accordance with various embodiments. The approach shown in FIG. 3 may, for example, be implemented with module 213 in FIG. 2, which may also be implemented with the apparatus 100 shown in FIGS. 1A-1C. A received sensor data packet is utilized at block 310 to update robot state information, including one or more of crank kinematics, pedal forces, robotic frame transformation, low-pass filter kinematics/kinetics, safety state, and EMG system state. In some implementations, a human state estimation block 312 utilizes the robot state and estimates a human state of a user, and provides a corresponding output. The human state estimation block 312 may utilize a biomechanical model such as body kinematics model or a musculoskeletal model, such as using models provided in OpenSim 3.2, released on Mar. 13, 2014 and available from Simbios at the NIH Center for Biomedical Computation at Stanford University, California.

A robot state and/or a human state output may be provided to a visualizer for a user, such as a patient and/or a therapist, as well as to a haptic environment controller module 320. The haptic environment controller module 320 may extract a relevant robot and/or human state and apply transformations to calculate input variables, apply an input to an internal model/haptic control law and use that to calculate an output to command a motor controller (e.g., 130 of FIG. 1). An output target torque or velocity may be sent to a motor controller from the haptic environment controller module 320.

Figure 4:
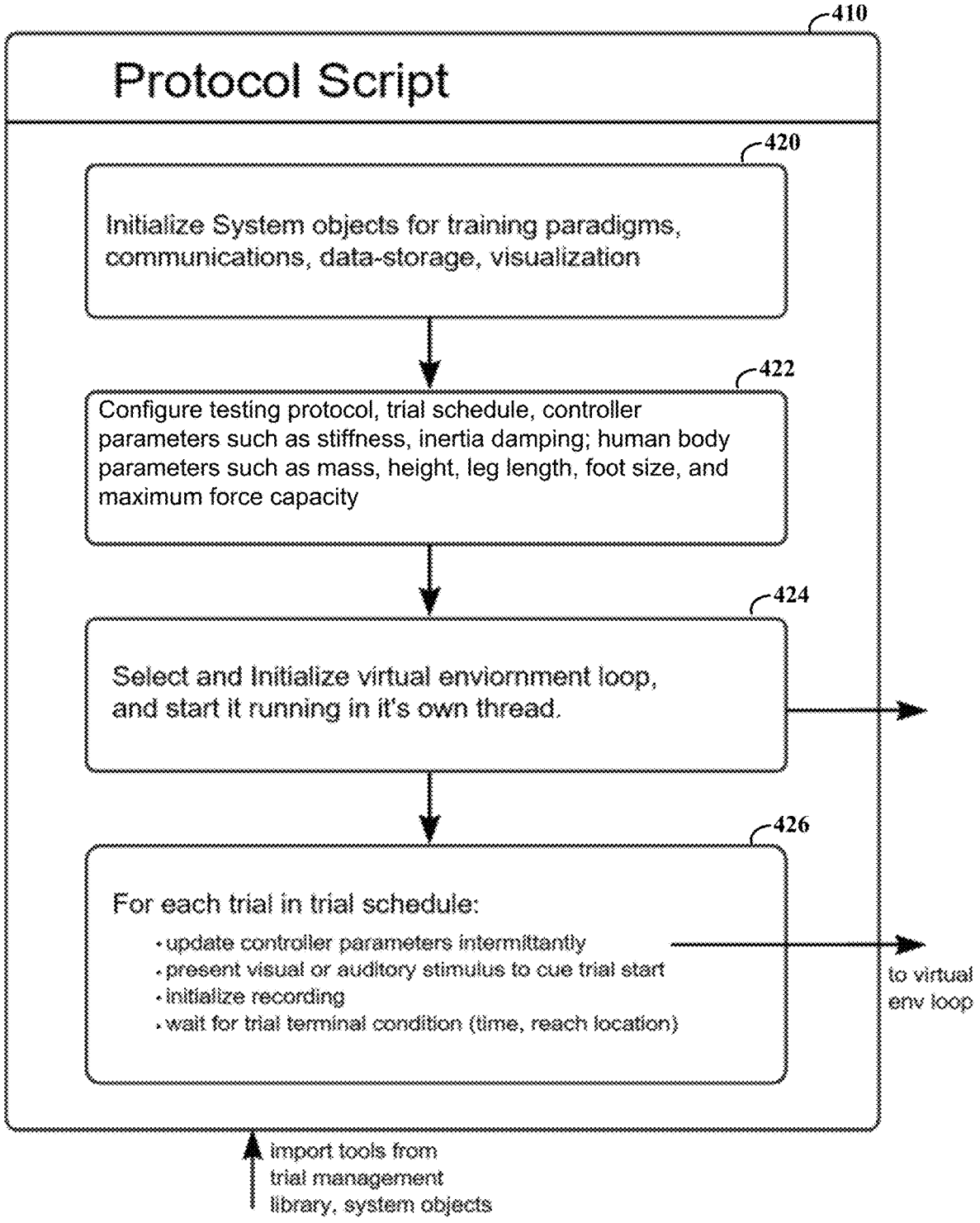
FIG. 4 shows a flow diagram for operating a haptic apparatus, as may be implemented in accordance with various embodiments.

FIG. 4 shows a flow diagram for operating a haptic apparatus, as may be implemented in accordance with various embodiments. Specifically, a protocol script module 410 as may be implemented with module 211 in FIG. 2, and/or a GUI as noted herein, carries out respective blocks/functions 420, 422, 424 and 426. At block 420, system objects are initialized for training paradigms, communications, data storage and visualization. A testing protocol is configured at block 422, along with a trial schedule, and controller parameters such as stiffness, inertia and damping, as well as various human body parameters as indicated, may be set. At block 424, a virtual environment loop is selected and initialized to run on its own thread. At block 426, each trail in a trial schedule (e.g., for providing a patient with haptic training), controller parameters are updated, stimulus is provided to cue the patient to start, and recording is initialized. These aspects are carried out until a terminal condition as may be set by a timer or other condition, and related outputs can be provided to a virtual envelope loop (e.g., as in FIG. 3). Such an approach may involve utilizing control signals and/or altered parameters from the protocol script module depicted in FIG. 4, which may also provide a selected haptic environment (e.g., from library of predefined environments). The protocol script module may import tools from a trial management library, system objects, and other information for carrying out the indicated functions.

Figure 5:
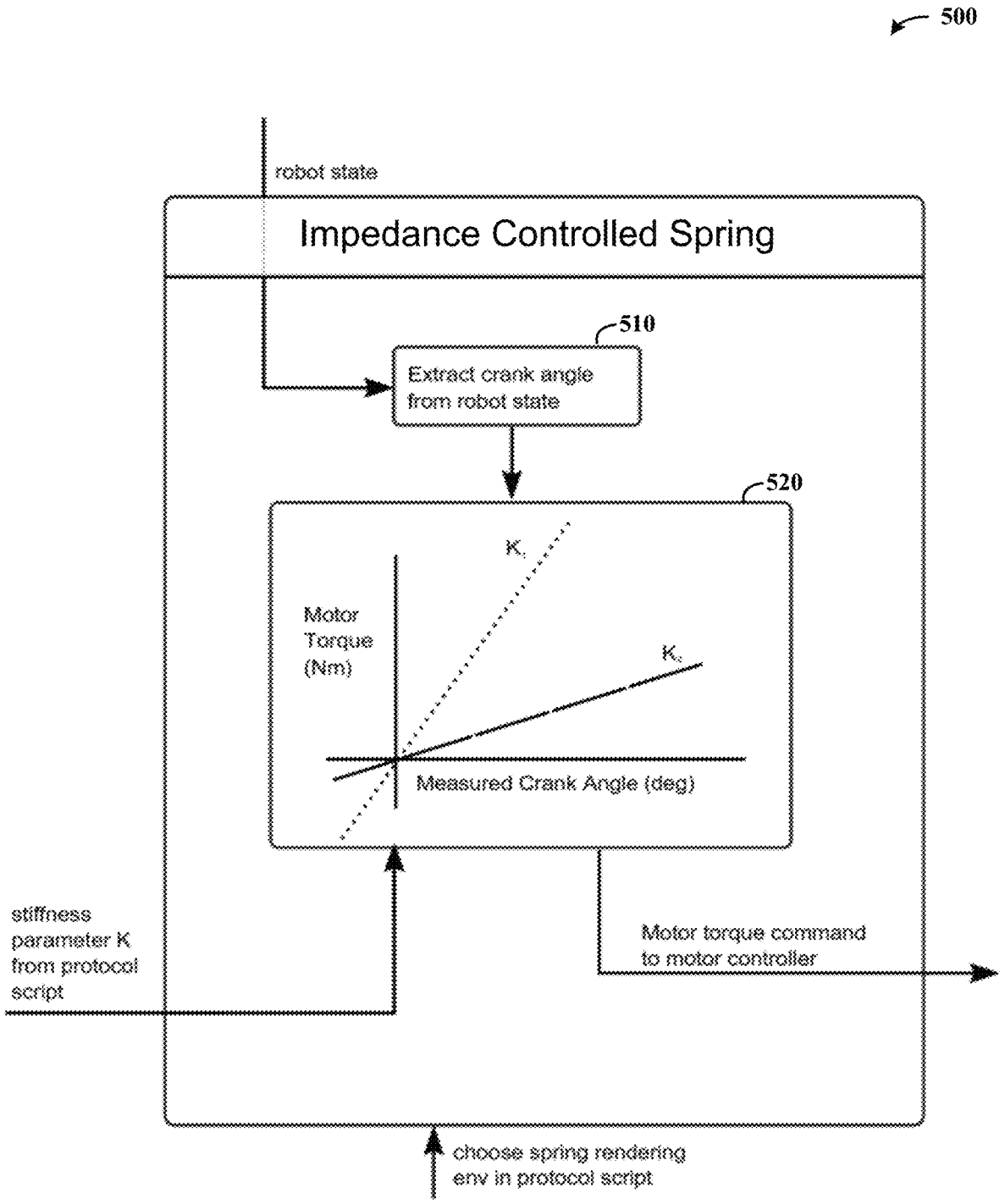
FIG. 5 shows a module for controlling a haptic apparatus for operating with impedance spring characteristics, as may be implemented in accordance with various embodiments.

FIG. 5 shows a (circuit) module 500 for controlling a haptic apparatus for operating with impedance-controlled spring characteristics, as may be implemented in accordance with various embodiments. The module 500 includes an extraction block 510 configured to extract a crank angle from a robot state, such as to extract an angle of one or both cranks 140/142 as depicted in FIG. 1A. This crank angle is utilized at block 520 to ascertain a torque value, using stiffness inputs (e.g., from the protocol script module 410 in FIG. 4). This information may be used to generate a motor torque command output to a motor controller, such as within motor 130.

Figure 6:
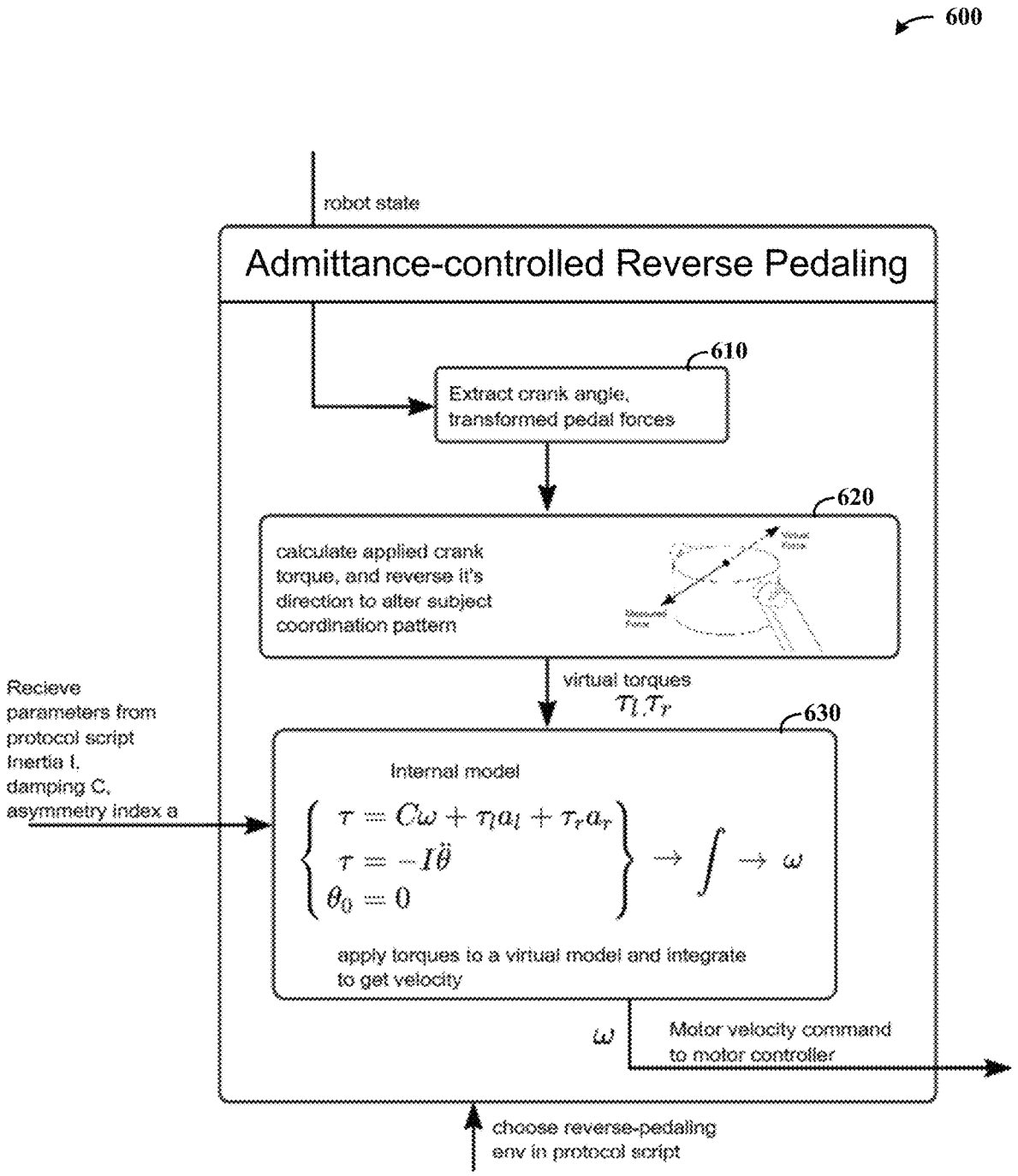
FIG. 6 shows a module for controlling a haptic apparatus for operating with admittance reverse-pedaling characteristics, as may be implemented in accordance with various embodiments.

FIG. 6 shows a module 600 for controlling a haptic apparatus for operating with admittance-controlled reverse-pedaling characteristics, as may be implemented in accordance with various embodiments. The module 600 includes an extraction block 610 configured to extract crank angle and pedal forces. Block 620 is configured to generate virtual torques, such as by calculating applied crank torque and reversing its direction. Block 630 is configured to utilize an internal model (e.g., with an example shown) to retrieve and process parameters from a protocol script as may be implemented via module 410, and generates a motor velocity command output as may be provided to motor 130. This output may be generated based on a provided reverse-pedaling environment, as may be set by module 410.

Various blocks, modules or other circuits may be implemented to carry out one or more of the operations and activities described herein and/or shown in the figures. In these contexts, a "module" (as may be referred to as "circuitry" or "block") is a circuit that carries out one or more of these or related operations/activities (e.g., processing feedback to present control outputs as in the figures, such as with the modules depicted in FIG. 2). For example, in certain of the above-discussed embodiments, one or more modules are discrete logic circuits or programmable logic circuits, configured and arranged for implementing these operations/activities. In certain embodiments, such a programmable circuit is one or more computer circuits programmed to execute a set (or sets) of instructions (and/or configuration data). The instructions (and/or configuration data) can be in the form of firmware or software stored in and accessible from a memory (circuit). As an example, a module may involve computing circuitry and data including instructions that, when executed by the computing circuitry, exhibit the claimed functional operation. In addition, the various embodiments described herein may be combined in certain embodiments, and various aspects of individual embodiments may be implemented as separate embodiments. Certain embodiments are directed to a computer program product (e.g., nonvolatile memory device), which includes a machine or computer-readable medium having stored thereon instructions which may be executed by a computer (or other electronic device) to perform these operations/activities.

Based upon the above discussion and illustrations, those skilled in the art will readily recognize that various modifications and changes may be made to the various embodiments without strictly following the exemplary embodiments and applications illustrated and described herein. For example, upright bicycles may be utilized in applications characterized as using recumbent bicycles. Similarly, other apparatuses utilizing similar rotational characteristics may be used, such as a single-crank apparatus for one foot, or an apparatus that may be pedaled while sitting in a chair (e.g., mounted on a floor). As another example, the modules/circuits depicted or described with FIGS. 2-6 may be implemented within and/or connected to the motor 130 as control circuitry therein. Such modifications do not depart from the true spirit and scope of various aspects of the invention, including aspects set forth in the claims.

What is claimed is:

1. An apparatus comprising:

a shaft configured to rotate;

a motor configured to apply torque to the shaft;

a crank coupled to the shaft;

a support configured to support a user while a lower extremity of the user is engaged with the crank, the crank being configured to translate mechanical force between the shaft and the user's lower extremity;

feedback circuitry configured and arranged to sense engagement of the user with the crank and to provide feedback signals characterizing the sensed engagement; and motor control circuitry configured and arranged to provide force by controlling movement of the crank via the motor and shaft in response to the feedback signals, including applying control inputs to the motor that cause crank to render respective haptic rehabilitation environments based on the feedback signals and while engaged with the user's lower extremity, by rotating the shaft in accordance with predefined protocol scripts for the haptic rehabilitation environments, the haptic rehabilitation environments including an environment selected from the group of: impedance-based haptic environments, admittance-based haptic environments, and a combination thereof.

2. The apparatus of claim 1, wherein the motor control circuitry is configured to apply the control inputs to the motor that cause the crank to exhibit a force or movement that dynamically changes based on one or both of the sensed engagement of the user and a type of rehabilitative motion to be provided, including providing control inputs for reverse pedaling characteristics.

3. The apparatus of claim 1, wherein the motor control circuitry is configured and arranged to:

utilize the feedback signals to characterize deficits and capacity in performance of the user's lower extremity; and modify control of the movement of the crank in response to the characterized deficits and capacity.

4. The apparatus of claim 1, wherein the motor control circuitry is configured and arranged to control the movement of the crank by:

utilizing the feedback circuitry, measuring a signal from the user's body indicative of the user's response to haptic rehabilitative movement provided via the force;

providing an output value for an available output, using a mathematical model that relates the measured signal to the available output; and actuating the crank using one or both of impedance-based control and admittance-based control, based on the output value.

5. The apparatus of claim 4, wherein providing the output value includes selecting an output value in response to the user's ability to control the lower extremity, as detected via the feedback circuitry.

6. The apparatus of claim 4, wherein providing the output value includes providing a value corresponding to mechanical characteristics of the crank selected from the group of: position, velocity, force, and a combination thereof.

7. The apparatus of claim 4, wherein:

the apparatus further includes memory circuitry configured to store a plurality of mathematical models, each model corresponding to a different type of haptic rehabilitation, and providing the output value includes selecting one of the mathematical models and controlling movement of the crank in accordance with the selected mathematical model.

8. The apparatus of claim 7, wherein the motor control circuitry is configured and arranged to select the one of the mathematical models based on received user input.

9. The apparatus of claim 7, wherein the mathematical models are configured with at least one variable corresponding to the sensed engagement of the user, and wherein controlling the movement of the crank in accordance with the selected mathematical model includes using the sensed engagement as the at least one variable within the mathematical model to generate the output value.

10. The apparatus of claim 4, wherein the motor control circuitry is configured and arranged to actuate the crank using impedance-based control by detecting one or both of velocity of the crank and position of the crank caused by the user, and applying force to the crank based on one or both of the detected velocity of the crank and the detected position of the crank.

11. The apparatus of claim 4, wherein the motor control circuitry is configured and arranged to actuate the crank using admittance-based control by imposing motion of the user based on a detected characteristic selected from the group of: force, position, velocity, and a combination thereof.

12. The apparatus of claim 1, wherein the feedback circuitry is configured to sense the engagement of the user by sensing an engagement selected from the group of: foot position, leg position, foot angle, force applied between the foot and crank, muscular activity, and a combination thereof.

13. The apparatus of claim 1, wherein:

the crank is configured and arranged with the shaft to limit movement to one degree of freedom rotational movement in a single plane; and the motor control circuitry is configured and arranged with the motor and feedback circuitry to provide haptic rehabilitative movement for training out-of-plane movement by dynamically controlling the translated mechanical force while rotating the crank in the single plane.

14. The apparatus of claim 1, wherein the motor control circuitry is configured to cause the crank to render the respective impedance-based and admittance-based haptic environments by moving to and maintaining respective positions or associated forces corresponding to reach-locations for the user, the feedback circuitry being configured to provide feedback signals characterizing engagement of the user with the crank at each reach-location.

15. The apparatus of claim 1, wherein the motor control circuitry is configured to cause the crank to render the impedance-based haptic environments using position or velocity as an input and controlling force in response thereto.

16. The apparatus of claim 1, further including a user interface configured and arranged to provide information to the user, wherein the motor control circuitry is configured and arranged with the user interface to provide user feedback and task specification based on the sensed engagement.

17. The apparatus of claim 1, wherein:

the crank is configured and arranged with the shaft rotate in a plane and therein provide single degree of freedom movement; and the feedback circuitry includes sensor circuitry configured and arranged to sense force and torque in the plane and to sense out-of-plane force and torque applied by the user to the crank.

18. The apparatus of claim 17, further including a pedal configured to engage with the user's lower extremity and to translate the mechanical force and torque between the crank and the user.

19. A method for providing haptic rehabilitative movement, the method comprising:

providing feedback signals characterizing sensed engagement of a user's lower extremity with a crank coupled to a shaft that is driven by a motor; and controlling movement of the crank via force provided by the motor and shaft in response to the feedback signals, by applying control inputs to the motor that cause the motor and crank to render respective haptic rehabilitation environments while engaged with the user's lower extremity, by rotating the shaft in accordance with predefined protocol scripts for the haptic rehabilitation environments, the haptic rehabilitation environments including an environment selected from the group of: impedance-based haptic environments, admittance-based haptic environments, and a combination thereof.

20. The method of claim 19, further including using a support structure to support the user while the user's lower extremity is engaged with the crank.

* * * * *